United States Patent [19]

Lenz

[11] 4,046,487

[45] Sept. 6, 1977

[54] TURBINE BLADE INDEXING ASSEMBLY

[75] Inventor: Herman N. Lenz, Lambertville, Mich.

[73] Assignee: Teledyne Industries, Inc., Los Angeles, Calif.

[21] Appl. No.: 606,071

[22] Filed: Aug. 20, 1975

[51] Int. Cl.[2] ..... F01D 5/30

[52] U.S. Cl. ..... 416/208; 416/168 A; 73/455

[58] Field of Search ..... 416/207, 208, 168; 73/455, 147

[56] References Cited

U.S. PATENT DOCUMENTS

| | | | |
|---|---|---|---|
| 1,496,776 | 6/1924 | Fuller | 416/207 |
| 2,341,207 | 2/1944 | Carol | 416/168 |
| 2,350,383 | 6/1944 | Bebinger | 416/207 |
| 2,382,535 | 8/1945 | Bauer | 416/207 |

FOREIGN PATENT DOCUMENTS

| | | | |
|---|---|---|---|
| 1,435,444 | 3/1966 | France | 416/207 |
| 1,038,231 | 9/1958 | Germany | 416/168 |
| 85,470 | 2/1896 | Germany | 416/168 |
| 1,945,954 | 3/1971 | Germany | 416/208 |
| 169,140 | 10/1959 | Sweden | 416/168 A |

*Primary Examiner*—Everette A. Powell, Jr.

*Attorney, Agent, or Firm*—Gifford, Chandler, Sheridan & Sprinkle

[57] ABSTRACT

A turbine blade indexing assembly adapted for variably adjusting the pitch of the turbine blades in a turbine wheel. The indexing assembly includes a housing secured to a turbine hub and an indexing ring contained between the housing and the hub and adapted for limited rotational movement relative to the housing. A plurality of radial bores are formed around the periphery of the housing and each bore is adapted to receive a cylindrical shank of the turbine blade therethrough. A blade retainer ring, having a transverse bore adapted to register with a transverse bore formed through the turbine blade shank, is positioned on each turbine blade shank so that a pin member inserted through the registering bores in the shank and retainer ring rotatably secures the turbine blade to the housing. One end of the pin member is received in an actuator slot formed in the indexing ring so that rotational movement of the indexing ring produces a corresponding axial rotation of the turbine blades. At least one bolt is provided to secure the indexing ring to the housing in order to prevent further rotational movement of the indexing ring relative to the housing after the proper turbine blade pitch is obtained.

2 Claims, 6 Drawing Figures

TURBINE BLADE INDEXING ASSEMBLY

BACKGROUND OF THE INVENTION

I. Field of the Invention

The present invention relates generally to turbine wheel assemblies and, more particularly, to an indexing assembly adapted to variably adjust the pitch of the turbine blades.

II. Description of the Prior Art

In many turbine applications it is desirable to variably adjust the pitch, aerodynamic design, and/or density of the turbine blades without the necessity of manufacturing a new turbine wheel. The capability to variably adjust the above mentioned design criteria is particularly desirable in test rig applications where the optimum turbine design, blade pitch and density is initially undetermined. The cost of manufacturing a multiplicity of different turbine wheel assemblies in order to determine the optimum turbine wheel design is necessarily prohibitive particularly in view of the large number of possible permutations involved. Heretofore no adequate turbine test rig has been developed capable of quickly, inexpensively, and accurately varying either the turbine blade design, pitch or density for a turbine wheel.

SUMMARY OF THE PRESENT INVENTION

The turbine blade indexing assembly of the present invention overcomes the above mentioned limitations of the previously known turbine assembly test rigs by providing an apparatus whereby the pitch of turbine blades may be variably adjusted and thereafter locked in place. The present invention comprises a housing secured to a turbine hub by any conventional means and an indexing ring contained between the housing and the hub and adapted for rotation relative to the housing within predetermined limits. A plurality of radial bores are formed around the periphery of the housing and each bore is adapted to receive a cylindrical shank of the turbine blade therethrough. A blade retainer ring, having a transverse bore adapted to register with a transverse bore formed through the turbine blade shank, is positioned on each turbine blade shank so that a pin member inserted through the registering bores in the shank and the retainer ring rotatably secures the turbine blade to the housing. One end of each pin member is received in an actuator slot formed in the indexing ring, so that rotational movement of the indexing ring produces a corresponding rotational movement of the turbine blades. At least one locking bolt is provided to secure the indexing ring to the housing against further rotational movement when the proper turbine blade pitch is obtained. In this manner the turbine blade pitch is infinitely variable within the limits of rotation of the indexing ring.

In order to change the turbine blade density, rather than replace the entire turbine wheel as was the previously known practice, only the turbine blade indexing assembly of the present invention having a different number of radial bores around the housing periphery must be substituted for the original turbine blade indexing assembly. Likewise, if a different turbine blade design is desired, the original turbine blades may be removed from the indexing assembly by withdrawing the pin members from the transverse bores through the blade retainer rings and the turbine blade shanks. Preformed turbine blades, having a different aerodynamic design than the original turbine blades, are then rotatably secured to the housing in the previously described fashion. In this manner only the turbine blades, rather than the entire turbine wheel, need be substituted in order to obtain a turbine wheel with a different aerodynamic design.

BRIEF DESCRIPTION OF THE DRAWINGS

The turbine blade indexing assembly of the present invention may be more clearly understood by reference to the following detailed description when read in conjunction with the accompanying drawing wherein like reference characters refer to like parts throughout the several views and in which.

DETAILED DESCRIPTION OF THE PRESENT INVENTION

Figure 1:
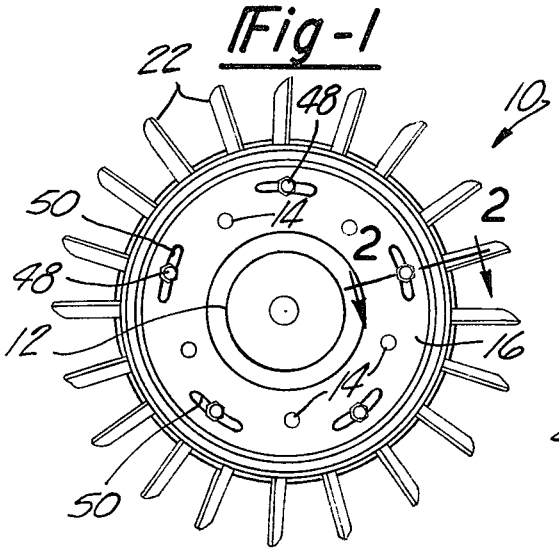
FIG. 1 is a front plan view showing the turbine blade indexing assembly of the present invention.
Figure 6:
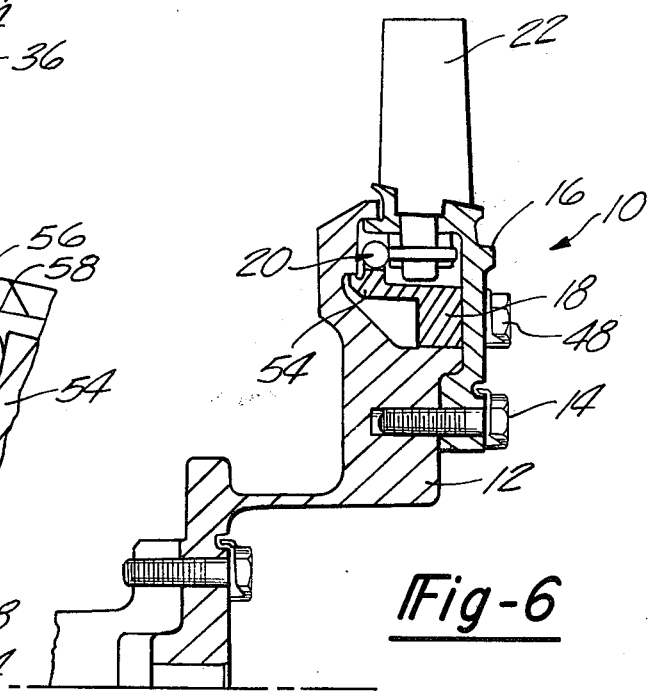
FIG. 6 is a side cross-sectional view showing the turbine blade indexing assembly of the present invention.

The turbine blade indexing assembly 10 of the present invention is shown FIGS. 1 and 6 secured to a turbine hub 12 by any conventional means such as bolts 14. The indexing assembly 10 generally comprises a housing 16, an indexing ring 18 (FIG. 6) and pin members 20 adapted to selectively vary the pitch of the turbine blades 22 in a manner to become hereinafter apparent.

Figure 2:
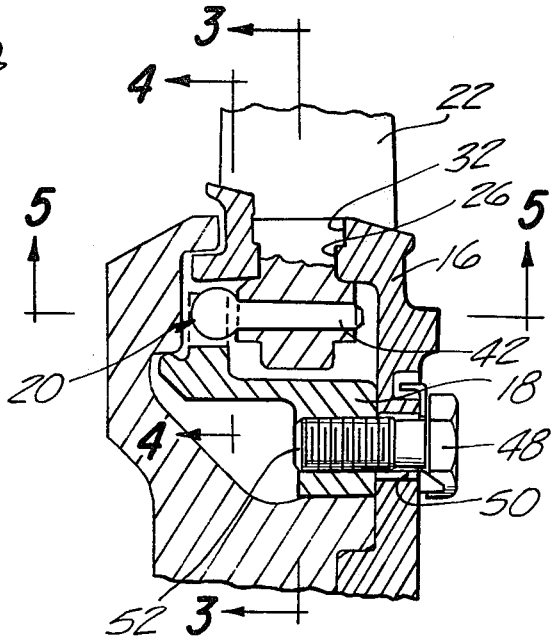
FIG. 2 is a partial sectional view taken substantially along line 2—2 in FIG. 1 and showing the turbine blade indexing assembly of the present invention with parts removed and enlarged for clarity.
Figure 3:
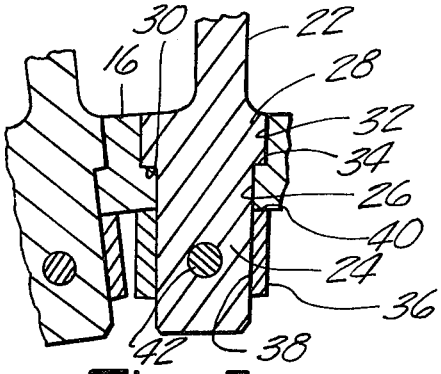
FIG. 3 is a cross-sectional view taken substantially along line 3—3 in FIG. 2.

Referring now primarily to FIGS. 2 and 3, a plurality of radial bores 26, having an outer enlarged diameter portion 32, are formed around the periphery of the indexing housing 16 so that an annular abutment surface 34 is formed by the junction of the bore 26 with its enlarged portion 32. Similarly each turbine blade 22 includes a cylindrical shank 24 with an enlarged diameter portion 28 so that an annular abutment surface 30 is formed by the junction of the shank 24 with its enlarged diameter portion 28. Each radial bore 26 is adapted to receive the shank 24 of a single turbine blade 22 therethrough so that the annular surfaces 30 and 34 abut against each other while permitting axial rotation of the turbine blade.

Figure 5:
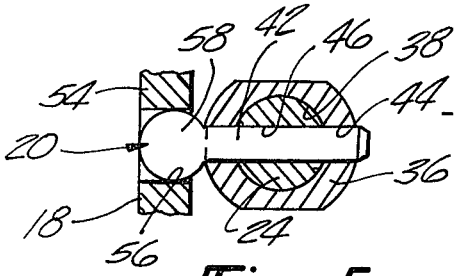
FIG. 5 is a cross-sectional view taken substantially along line 5—5 in FIG. 2.

As can best be seen in FIGS. 3 and 5, a blade retainer ring 36 having an axial bore 38 of substantially the same diameter as the turbine blade shank 24 is provided around the turbine blade shank 24 so that the upper surface 40 of the blade retainer ring 36 abuts against the housing 16. To secure the blade retainer ring 36 to the turbine blade shank 24 against both rotational and longitudinal movement, a shank portion 42 of the pin member 20 (see FIG. 5) is inserted through registering transverse bores 44 and 46, having substantially the same diameter as the shank portion 42, formed respectively through the blade retainer ring 36 and the turbine blade shank 24. With the retainer ring 36 secured to the turbine blade shank 24 by the pin member 20, the annular abutment surfaces 30 and 34 in conjunction with the abutment of the retainer ring upper surface 40 with the housing 16 prevents longitudinal movement of the turbine blade 22 relative to the housing 16 while permitting axial rotation of the blade 22 within the housing 16.

The indexing ring 18 is contained between the housing 16 and the turbine hub 12 so that the indexing ring 18 may rotate relative to the hub 12 and housing 16. At least one locking bolt 48 passes through a circumferentially oblong slot 50 in the housing 16 and threadably engages a threaded bore 52 in the indexing ring 18 so that by tightening the locking bolt 48, the indexing ring 18 is locked against rotation to the housing 16, and, hence, to the hub 12. The oblong slot 50 and locking bolt 48 also serve to limit the rotational movement of the indexing ring 18 relative to the hub 12 and housing 16.

Figure 4:
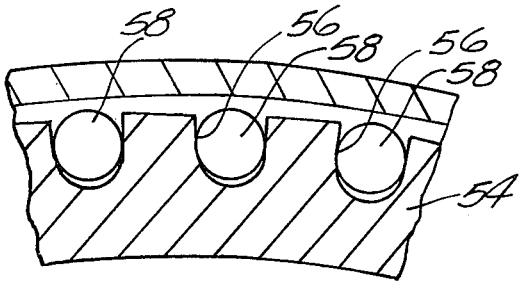
FIG. 4 is a cross-sectional view taken substantially along line 4—4 in FIG. 2.

The indexing ring 18 includes a portion 54 adjacent the blade retainer 26 having a plurality of actuator slots 56 formed symetrically around the indexing ring portion 54 as best shown in FIG. 4. One actuator slot 56 is provided for each turbine blade 22 and is adapted to receive a ball portion 58 of the pin member 20 therein. Preferably the width of each slot 56 is substantially the same as the diameter of the pin member ball portion 58 to elimiate any possible play of the pin member 20 within the slots 56.

Each turbine blade is assembled to the housing 16 by inserting the turbine blade shank 24 through the bore 26 in the housing 16 until the annular surfaces 30 and 34 abut against each other. The retaining ring 36 is then positioned over the turbine blade shank 24 and rotated until the bores 44 and 46 in the retaining ring 36 and shank 24, respectively, register and the shank 42 of the pin member 20 is then inserted through the actuator slot 56 and the bores 44 and 46 to lock the retaining ring 36 to the turbine blade 22. After each turbine blade 22 is secured to the housing 16 in the above described manner, the housing 16 is secured to the turbine hub 12 by the bolts 14.

In order to obtain the proper turbine blade pitch, with the locking bolts 48 loosened, the indexing ring 18 is rotated relative to the housing 16 and hub 12 by the locking bolts 48 or any other appropriate means. As best shown in FIG. 5, as the indexing ring 18 rotates the pin member ball portion 58 which is entrapped within the indexing rings actuator slot 56 rotates with the indexing ring 18 and effects a corresponding rotational movement of the turbine blade shank 24 in the obvious fashion. When the proper turbine blade pitch is achieved, the locking bolts 48 are tightened to prevent further rotational movement of the indexing ring 18 relative to the housing 16.

It is thus apparent that the turbine blade indexing assembly of the present invention provides a novel means whereby the pitch of the turbine blades may be infinitely varied without the necessity of producing multiple turbine wheels. Moreover the indexing assembly of the present invention provides a novel means whereby turbine blades of various designs may be simply and quickly assembled to the same indexing assembly by removing the pin members and retaining rings and reassembling a different set of turbine blades to the indexing assembly. Lastly if it is desirable to operate a turbine wheel with a different blade density, only the turbine blade indexing assembly, rather than the entire turbine wheel, need be substituted. Thus given a set of turbine blades with different aerodynamic designs and a set of indexing rings having different turbine blade densities, any desired combination of aerodynamic design, turbine blade density, and turbine blade pitch may be obtained with the turbine blade indexing ring of the present invention.

Many modifications to the present invention will become apparent to those skilled in the art to which it pertains without deviating from the spirit of the invention or the scope of the appended claims.

What is claimed is:

1. A device for testing the characteristics of a turbine assembly with the turbine blades adjusted through a wide range of pitches and with different numbers of turbine blades, said devices comprising:

a turbine hub adapted to be rotated, a housing provided with a plurality of circumferentially spaced radially extending bores, each of said bores having an inwardly extending shoulder portion intermediate the ends of said bores, a plurality of turbine blades, each being provided with a shank portion adapted to be received within said bores with an end extending beyond said bore, said shank portion having an enlarged abutment surface which seats against said shoulder formed in said bore when said shank portion is inserted radially inwardly into one of said bores, a retainer ring for each of said turbine blades, each of said retainer rings having an axial bore of substantially the same diameter as the end of said shank portion whereby said retainer ring will fit over the end of said shank portion, said retainer rings and said ends of said shank portion each having a diametrical bore therethrough and a pin member receivable in said diametrical bores to thereby lock said ring member to said shank portion and thus said turbine blade to said housing, said pin members each having a spherical head portion, an indexing ring detachably mounted to said housing and provided with a plurality of actuator slots disposed to receive the head portions of said pin members, means for selectively rotating said indexing ring to thereby move said head portions of said pin members whereby said turbine blades will be rotated about their axis to change the pitch thereof, said housing with said turbine blades being detachably mounted to said hub whereby said housing and said turbine blades can be removed as a unit from said hub to permit individual removal of said turbine blades from said housing for replacement or testing purposes or to permit said housing to be replaced by a similar housing having different turbine blade spacings to thereby permit the testing of the effect of different blade spacings on the operation of said turbine assembly.

2. The invention as defined in claim 1 wherein said last mentioned means further comprises at least one fastener threadably engaging an aperture in said indexing ring through an oblong opening in said housing so that the rotational position of said indexing ring is variable within the limits of the oblong shaped opening.

* * * * *